US005324409A

United States Patent [19]

Mayr et al.

[11] Patent Number: 5,324,409

[45] Date of Patent: Jun. 28, 1994

[54] ELECTRODE ARRANGEMENT FOR ELECTROLYTIC CELLS

[75] Inventors: Max Mayr, Alzenau; Wolfgang Blatt, Wächtersbach; Harri Heinke, Erlensee, all of Fed. Rep. of Germany

[73] Assignee: Heraeus Electrochemie GmbH, Hanau, Fed. Rep. of Germany

[21] Appl. No.: 927,273

[22] PCT Filed: Jan. 18, 1991

[86] PCT No.: PCT/EP91/00080

§ 371 Date: Sep. 11, 1992

§ 102(e) Date: Sep. 11, 1992

[87] PCT Pub. No.: WO91/14803

PCT Pub. Date: Oct. 3, 1991

[30] Foreign Application Priority Data

Mar. 17, 1990 [DE] Fed. Rep. of Germany ..... 4008684

[51] Int. Cl.[5] ..... C25B 9/04; C25B 11/00

[52] U.S. Cl. ..... 204/267; 204/284; 204/286; 204/288

[58] Field of Search ..... 204/253, 267, 284, 286, 204/254–258, 267–270, 252, 263–266, 231, 288

[56] References Cited

U.S. PATENT DOCUMENTS

| | | | |
|---|---|---|---|
| 3,788,965 | 1/1974 | Holsinger | 204/234 |
| 3,952,313 | 4/1976 | Levenson et al. | 204/267 |
| 4,075,077 | 2/1978 | Hodges | 204/269 |
| 4,194,961 | 3/1980 | Williams | 204/269 X |
| 4,772,369 | 9/1988 | Mercier | 204/231 X |
| 4,786,384 | 11/1988 | Gerhardt et al. | 204/269 X |
| 4,786,384 | 11/1988 | Gerhardt et al. | 204/149 |
| 5,049,252 | 9/1991 | Murrell | 204/269 X |

FOREIGN PATENT DOCUMENTS

| | | |
|---|---|---|
| 2213401 | 10/1973 | Fed. Rep. of Germany . |
| 2659253 | 6/1978 | Fed. Rep. of Germany . |
| 2490683 | 3/1982 | France . |

*Primary Examiner*—Donald R. Valentine

*Attorney, Agent, or Firm*—Frishauf, Holtz, Goodman & Woodward

[57] ABSTRACT

An electrode arrangement for electrolytic purposes has a plurality of cathodes and one or a few anodes, so that an advantageous surface ratio between cathodes and anodes results. The cathodes, provided with openings, are embodied as plates and are arranged parallel at distances from each other, the cathodes being supported in a support device with an electrically insulating surface.

13 Claims, 2 Drawing Sheets

ELECTRODE ARRANGEMENT FOR ELECTROLYTIC CELLS

The invention relates to an electrode arrangement for an electrolysis cell with an anode and with at least two plate-shaped cathodes, which are electrically insulated from one another and disposed on one side of the anode at a distance from each other, where each cathode has at least two openings for flow-through of electrolyte and whre the cathodes are at electrically higher potential with increasing distance from the anode.

BACKGROUND

An electrolysis cell for the electrolytic separation of metals out of a liquid containing metal ions is known from German Patent DE-PS 36 40 020, and U.S. Pat. No. 4,786,384, GERHARD et al., which has, in a trough, at least one anode and a plurality of flat cathodes disposed parallel level to each other and at a distance from each other, which are each connected by means of their own connectors with the power supply via connecting resistances of various sizes.

The electrode plates used as cathodes are individually arranged in the trough and have sufficient stability; they can also be swapped out individually. Due to the wall thicknesses required for the stability of the individual cathodes, there is a comparatively high loss of material in the course of each change or swap of the cathodes when it occurs.

An electrolysis cell is also known from U.S. Pat. No. 3,788,965, HOLISINGER where an anode plate with a plurality of cathode plates disposed at a distance from each other, but where only the cathode plate which is farthest away from the anode is connected with the negative potential of the power supply. The cathode plates have openings for a zig-zag-shaped ion flow, in the course of which copper from the solutions containing copper ions is deposited on the plates themselves. Following deposition of copper, the cathode plates are swapped out and replaced by non-plated cathode plates.

According to the U.S. Patent, a certain mimimum wall strength of the electrode plates, used as cathode plates, is also required because they must be individually swapped out, which also results in high material losses upon every swap-out.

Further, German patent disclosure 2 213 401 (A), JACCAUD, discloses an electrolysis apparatus for silver recovery from an upstream photographic fixing bath, in which the cathode plates are fastened on a common carrier, parallel to each other with interposed spacer rings, and are suspended as a cathode packet on a housing wall of the apparatus. The anodes, which are rod-shaped with circular cross-section, are arranged along the housing wall in a plane which runs perpendicular to the plane of the individual cathode plates.

Problematical, in this connection, is the relatively great requirement for anode material, since the service life of the anodes is limited and, due to the multiplicity of anodes, extensive/expensive swapping out is necessary.

Proceeding from German Letters Patent DE-PS 36 40 020, GERHARDT et al., it is the object of the invention to provide material-saving cathode systems with large cathode surfaces, with which it is possible to achieve high current efficiency in spite of low material and production costs. In addition, it is also intended to obtain easy handling during operation.

In a preferred embodiment, the support device consists of four rods guided through recesses in the electrode plates, where spacer elements are disposed between the electrode plates, and the respectively outside electrode plates are pressed together by means of arresting devices acting on the bolt ends. The spacer elements are either tubularly formed, where they each envelop a bolt, or they are formed in the shape of pockets, which envelop the electrode plates; the pocket-shaped spacer elements are provided with recesses for putting the bolts through and for the admittance of liquid to the electrode plates.

In a further preferred embodiment, the support device is comb-shaped, in which case the spacer elements, as integral parts of the support device, form the teeth of the comb; in this case several such comb-like support devices are connected via a bar.

The electrode plates have a wall thickness in the range between 0.04 to 0.25 mm, where the ratio of the wall thickness to the distance of the electrodes lies in the range between 1 to 50 to 1 to 300. A wall thickness of 0.1 mm has proven to be particularly practical. The openings are evenly distributed over the electrode surface.

Contact strips are disposed laterally or at the top and bottom for improving contact, each of which is provided with a plate lug.

The comparatively simple handling has proven to be advantageous, because now a cathode exchange can take place in the form of an exchange of an entire electrode package; based on the mutual insulation of the electrode plates from each other it is possible in this case to set an optimal current density corresponding to the respective position of the electrode plate, so that all electrode plates can be removed showing a uniform degree of plating.

DRAWINGS

The subject of the invention will be described in detail below by means of FIGS. 1 and 2.

FIG. 1 shows an electrode arrangement maintained by bolts and ring-shaped spacer elements with a plate-shaped backplate electrode disposed outside of the support device, FIG. 2 shows an electrode arrangement with a support consisting of four frames, in which the spacer elements integrated into the plate-shaped frame are embodied to be comb-like; the backplate electrode is disposed outside of the support device.

DETAILED DESCRIPTION

Figure 1:
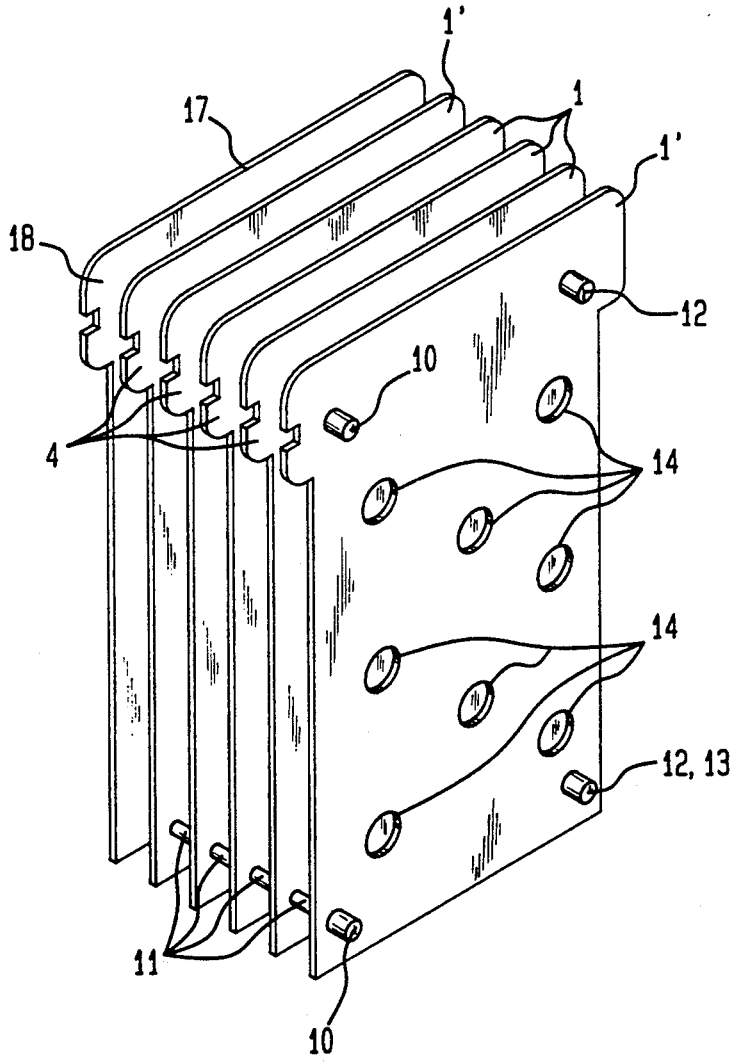

In accordance with FIG. 1, the electrode plates 1, 1' each have a recess in the area of their corners, through each of which a rod 10 with an electrically insulated surface has been guided. Electrically insulating spacer elements 11 in the form of annular sleeves are provided between the electrode plates 1, 1', where the spacer elements 11 and the electrode elements 1, 1' are pressed together by arresting devices 13 acting on the rod ends 12. Each of the arresting devices consists of a screw thread at the bolt end. However, it is also possible to provide each one of the bolts with a head on one side and only to provide the rod or bolt end 12 with a thread.

Metal foils are used as electrode plates, which have several evenly distributed openings 14 on their surfaces. The electrode plates 1, 1' have a thickness of approximately 0.05 mm; they consist of a metal adapted to the metal ions to be deposited. In devices for copper deposition they preferably consist of copper or a copper alloy, in devices for nickel deposition preferably of nickel or a nickel alloy.

The plate-shaped backplate electrode 17 used as an anode is disposed outside of the support device and provided with a plate lug 18; it is arranged parallel to the electrode plates 1, 1'.

Figure 2:
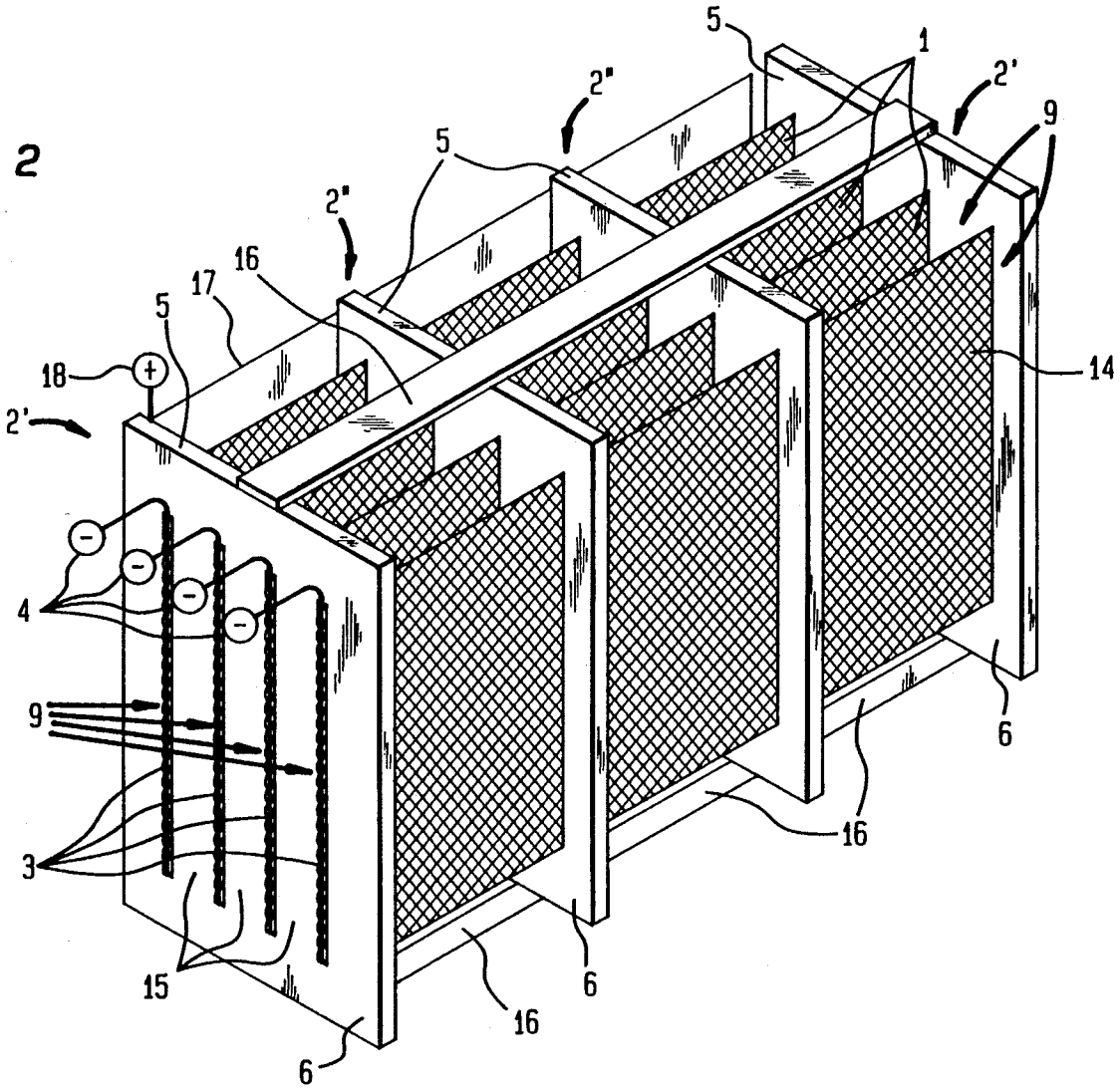

In accordance with FIG. 2, the electrode arrangement has four electrode plates 1, which are held in four plate-shaped support devices 2', 2''. In this case the planes of the support devices are oriented perpendicularly to the planes of the electrode plates 1, the two outer support devices 2' holding the respectively oppositely located edges of the electrode plate 1, while the central support devices 2'', disposed between the two outer support devices 2', envelop the central area of the electrodes 1. The electrode plates 1, which consist for example of metal mesh, are each provided on at least one side with a current collector 3, which is electrically and mechanically firmly connected with each one of a connector lug 4. The size of the opening 14 is preset because of the dimensions of the mesh length, mesh width and bar width of the metal mesh.

The support devices 2', 2'' have comb-like recesses 9 for receiving the electrode plates 1, where the inner width of the recesses is slightly greater than the wall thickness of the electrode plates. The spacer elements 15, embodied as the comb tines, are located between the recesses 9, which are directly fastened on a cross bar 5 to form the back of the comb and form an integral component together with it, while the opposite cross bar 6 is only installed after the insertion of the electrode plates 1 in such a way that it is mechanically firmly connected with the free ends of the spacer elements; in this way the electrode plates 1 are arrested on two oppositely located edges by the cross bars 5,6 secure against lateral displacement or sliding.

The support devices 2', 2'' are mechanically firmly connected at their outer edges with each other in the area of the cross bars 5, 6 by outer bars 16, so that a coherent electrode package is formed. The plate-shaped backplate electrode 17 used as the anode is disposed outside of the support device and provided with a plate lug 18; it is oriented parallel to the electrode plates 1.

The construction of the electrode plates to form an electrode package takes place in steps by inserting the electrode plate 1 into the outer support device 2', where the connecting lugs 4 of all electrode plates 1 are in the immediate vicinity of the support device 2''. Subsequently the center support devices 2'' are pushed on this and positioned in the central area of the electrode plates 1; final production takes place by applying the second outer support device 2'' and the subsequent connection of all support devices 2', 2'' by means of outer bars 16.

We claim:

1. An electrode arrangement for an electrolysis cell with multiple electrodes, namely an anode (17) and at least two plate-shaped cathodes (1, 1'), which are electrically insulated from one another and disposed on one side of the anode (17) at respective distances from each other, wherein each cathode is formed with at least two openings (14) for flow-through of electrolyte, the cathodes (1, 1') are at electrically higher potential with increasing distance from the anode (17), the cathodes (1) are held by a support device, of which at least the surface consists of an electrically nonconducting material, and wherein said distances between the cathodes (1) are preset by spacer elements (11), forming parts of at least two support rods (10) which collectively define said support device.

2. An electrode arrangement in accordance with claim 1, wherein the support device consists of at least two support rods (10) disposed at a distance from each other, and the spacer elements (11) constitute parts of the support rods (10).

3. An electrode arrangement in accordance with claim 2, wherein the support device consists of four support rods (10) guided through recesses in the cathodes, where the respectively outer electrode plates (1') are pressed together by arresting devices (13) acting on ends (12) of the rods.

4. An electrode arrangement in accordance with claim 3, wherein each cathode has a plurality of openings (14), which are evenly distributed over the cathode surface.

5. An electrode arrangement in accordance with claim 2, wherein each cathode has a plurality of openings (14), which are evenly distributed over the cathode surface.

6. An electrode arrangement in accordance with claim 1, wherein each cathode has a plurality of openings (14), which are evenly distributed over the cathode surface.

7. An electrode arrangement in accordance with claim 6, wherein each cathode has a plurality of openings (14), which are evenly distributed over the cathode surface.

8. An electrode arrangement in accordance with claim 1, wherein the support device comprises four of said support rods (10), extending through respective recesses formed in said cathodes, and arresting devices (13) engage on outwardly protruding ends (12) of said rods (10) and thereby urge outermost ones (1', 17) of said electrodes toward each other.

9. An electrode arrangement in accordance with claim 8, wherein each cathode has a plurality of openings (14), which are evenly distributed over the cathode surface.

10. An electrode arrangement for an electrolysis cell with multiple electrodes, namely an anode (17) and at least two plate shaped cathodes (1, 1') each with an individual connection to a power supply, which are electrically insulated from each other and disposed on one side of the anode (17) at respective distances from each other and at electrically higher potential with increasing distance from the anode wherein the cathodes are held in spaced relation to each other by a support device (2', 2'') having a generally comb-shaped structure including individual spacer elements (15) defining tines of the comb-shaped structure.

11. An electrode arrangement in accordance with claim 10, wherein several comb-shaped support devices (2', 2'') are provided, which are connected with each other by at least one bar (16).

12. An electrode arrangement in accordance with claim 11, wherein each cathode has a plurality of openings (14), which are evenly distributed over the cathode surface.

13. An electrode arrangement in accordance with claim 10, wherein each cathode has a plurality of openings (14), which are evenly distributed over the cathode surface.

* * * * *